United States Patent [19]

Junes

[11] 4,222,259

[45] Sep. 16, 1980

[54] PROPELLER RECONDITIONER

[76] Inventor: Norman E. Junes, Rte. 3, Box 148, Astoria, Oreg. 97103

[21] Appl. No.: 57,945

[22] Filed: Jul. 16, 1979

[51] Int. Cl.[3] ..... B21D 1/00

[52] U.S. Cl. ..... 72/293; 72/455; 269/49; 269/234; 29/156.8 P

[58] Field of Search ..... 72/293, 386, 455, 453.01, 72/453.18, 446; 29/156.8 P, 402.19; 269/49, 234

[56] References Cited

U.S. PATENT DOCUMENTS

| | | | |
|---|---|---|---|
| 3,032,092 | 5/1962 | Erlbacher | 72/293 |
| 3,512,325 | 5/1970 | Nichols | 269/234 |
| 4,027,867 | 6/1977 | Pollington | 269/234 X |

*Primary Examiner*—Robert C. Watson
*Attorney, Agent, or Firm*—Lee R. Schermerhorn

[57] ABSTRACT

A propeller is mounted on a vertical bolt on one end of a table. A horizontal radial wedge under the table is actuated by an hydraulic cylinder to tighten the bolt and clamp the propeller against rotation. A head frame is movable along the table by an hydraulic motor. An anvil beam and a presser foot beam are movable vertically in the head frame by hydraulic cylinders to clamp a blade of the propeller, remove dents, twist the blade and perform other operations as may be necessary to repair a damaged metal marine propeller.

20 Claims, 9 Drawing Figures

FIG. 7
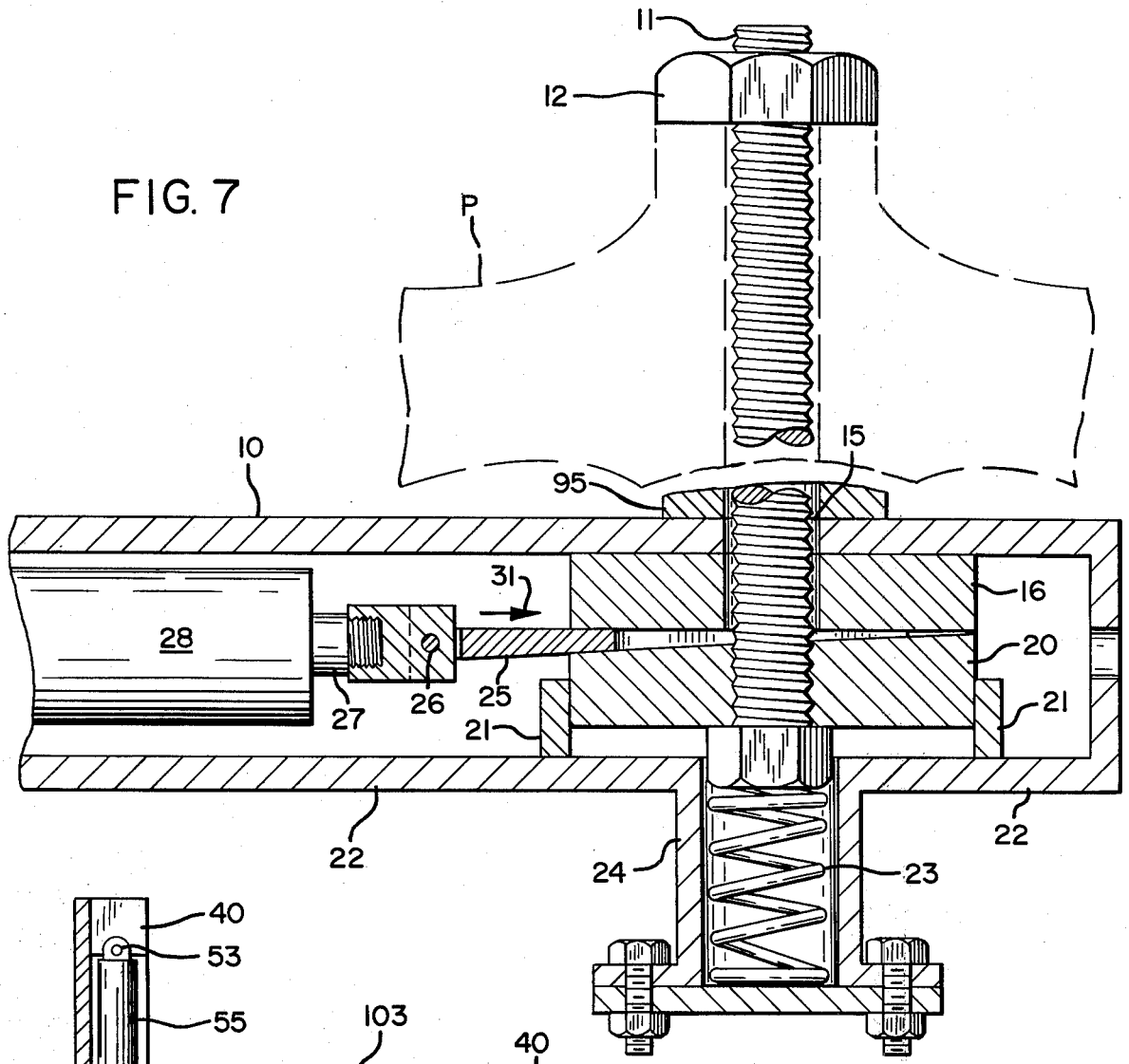
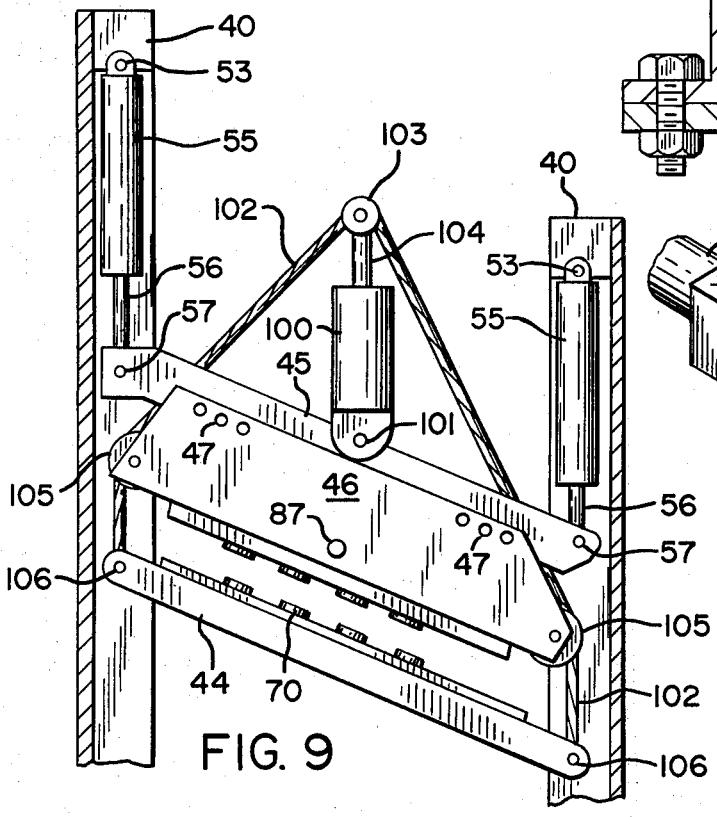
FIG. 9
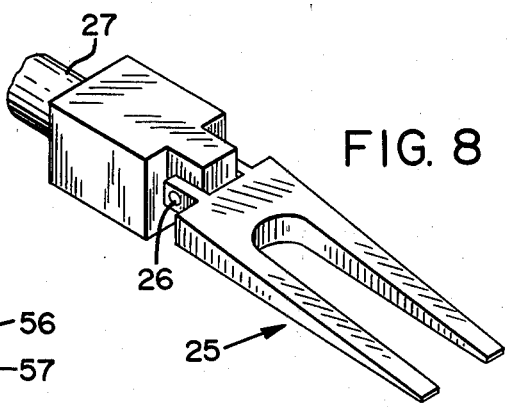
FIG. 8

PROPELLER RECONDITIONER

BACKGROUND OF THE INVENTION

This invention relates to a machine for reconditioning the blades of marine propellers that have been bent or dented.

The repair of metal propeller blades is a difficult and time consuming task because of the angle and curvature of the blades and the problem of restraining the propeller against rotation in order to hold the blades in a fixed position during such work. It has been conventional practice to place the propeller on a threaded shaft and then tighten a nut against the propeller hub with a hand wrench. It requires great strength and exertion to do this and then the nut must be loosened and the propeller rotated frequently during the course of the work. This makes the whole operation very tedious for the workman.

Objects of the present invention are therefore to provide an improved machine for reconditioning propellers, to provide power operated mechanisms for performing difficult operations heretofore performed manually, to provide an improved mechanism for holding the propeller against rotation and to provide improved mechanisms for bending and removing dents from the blades of the propeller.

SUMMARY OF THE INVENTION

In the present machine the propeller is secured on a threaded bolt by a hand tightened nut which does not even require the use of a wrench. Rotation of the propeller is prevented by a power operated wedge which cooperates with a nut on the other end of the bolt. The propeller may be repeatedly tightened and loosened on the bolt as frequently as necessary without manual effort.

The propeller is thus supported on a table which also carries a head frame that is power operated to shift its position along a blade of the propeller, toward and away from the propeller axis. Mounted for vertical movement in the head frame are a presser foot beam and an anvil beam arranged to clamp a propeller blade between the two beams by the action of hydraulic cylinders. Blocks are arranged on the beams to remove dents. Other hydraulic cylinders in the head frame are arranged to change the inclination of the clamping beams for repairing a bent blade. Thus, all operations heretofore requiring manual strength are performed quickly and easily by power operated mechanisms.

The invention will be better understood and additional objects and advantages will become apparent from the following description of certain preferred embodiments of the invention illustrated in the accompanying drawings. Various changes may be made in the details of construction and arrangement of parts and certain features may be used without others. All such modifications within the scope of the appended claims are included in the invention.

BRIEF DESCRIPTION OF THE DRAWINGS

FIG. 7 is a vertical sectional view showing the propeller holding mechanism.

FIG. 8 is a perspective view of the wedge in FIG. 7.

FIG. 9 is a fragmentary view similar to FIG. 2 showing a modification.

DESCRIPTION OF THE PREFERRED EMBODIMENT

Figure 1:
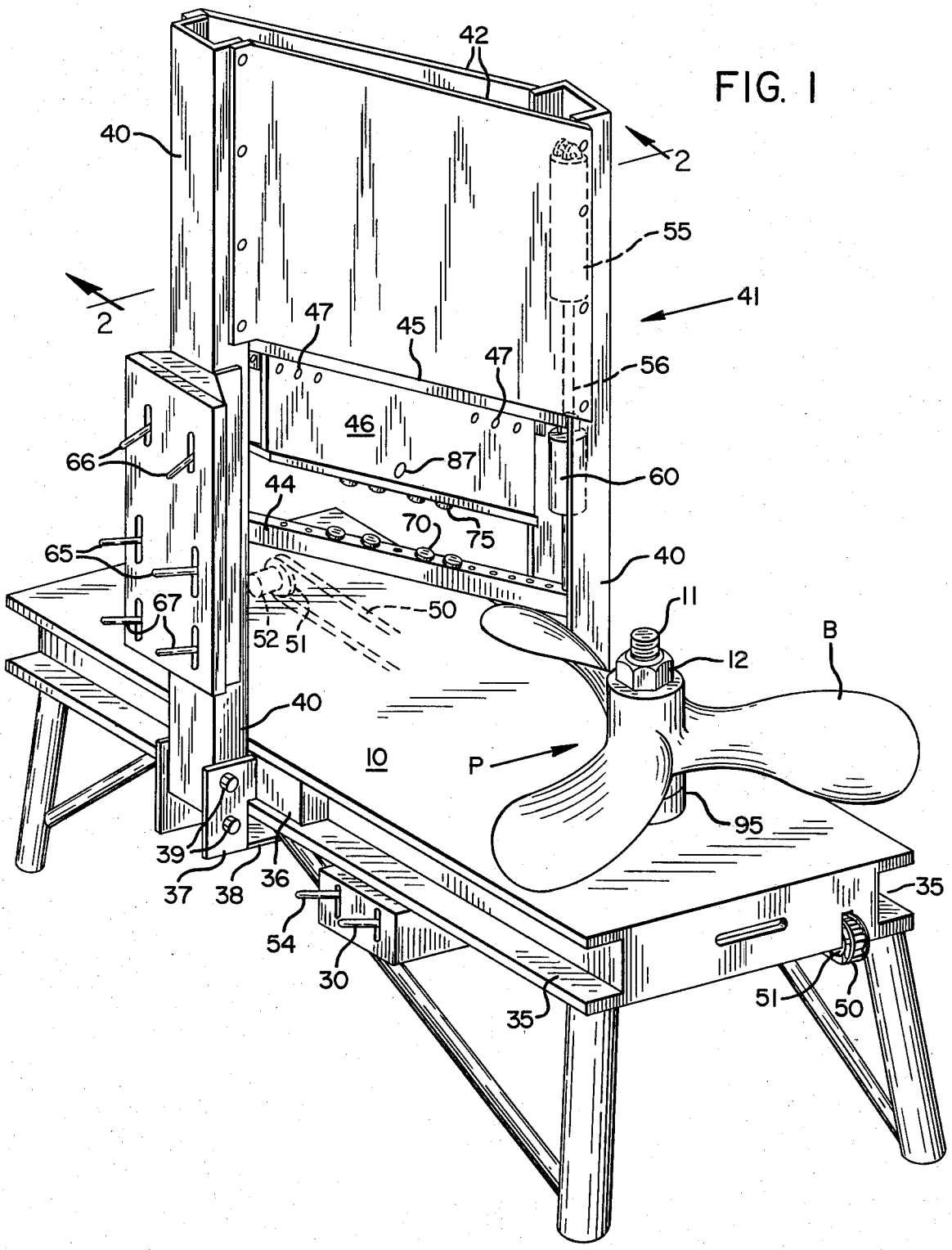
FIG. 1 is a perspective view of a machine illustrating a first embodiment of the invention.

In FIG. 1 the propeller P has blades B which require repair. The propeller is supported on a table 10 and mounted on a vertical bolt 11 having an upper nut 12 which is hand tightened, without a wrench, against the upper end of the propeller hub as shown. As seen in FIG. 7, bolt 11 extends loosely through an opening 15 in the table and through a block 15 in the nature of a washer. There is a lower nut 20 on the lower end of the bolt. Upstanding flanges 21 on a plate 22 under the table 10 prevent rotation of nut 20 while permitting it to move axially. To facilitate hand tightening of upper nut 12 the bolt 11 is supported and urged upward by a compression spring 23 in a spring housing 24 projecting below the plate 22.

The propeller is clamped against table 10 by the bifurcated wedge 25 in FIG. 8 which straddles bolt 11 between block 16 and nut 20. Wedge 25 is pivotally connected at 26 to the end of piston rod 27 in a double acting hydraulic cylinder 28. Wedge 25 is reciprocated by the three position valve control handle 30 in FIG. 1. In one position of valve handle 30 hydraulic fluid is admitted to the left end of cylinder 28 to force the wedge 25 in the direction of arrow 31 and in the opposite position of the valve handle hydraulic fluid is admitted to the right end of the cylinder to partially retract the wedge. In an intermediate position of the valve handle both end ports of the cylinder are closed to prevent movement of the piston and lock the wedge in its adjusted position.

Thus, the wedge is held in operative position without maintaining hydraulic pump pressure in the left end of the cylinder. Wedge 25 pulls bolt 11 down with a powerful force to clamp the propeller hub against table 10 so that the propeller cannot rotate during the work on the blades which will now be described.

Referring back to FIG. 1, grooves 35 on opposite sides of table 10 provide tracks for a pair of slides 36. Slides 36 are connected to brackets 37 on the opposite ends of a cross bar 38 which passes under the table. Pins 39 in the brackets 37 support the lower ends of a pair of vertical channel-shaped legs 40 of an inverted U-shaped head frame 41. The upper ends of legs 40 are rigidly connected together by a pair of vertical plates 42. Slidable vertically in the channel legs 40 are an anvil beam 44 and a presser foot beam 45 having a blade engaging shoe 46. Pins 47 provide for shifting shoe 46 lengthwise on beam 45.

Figure 2:
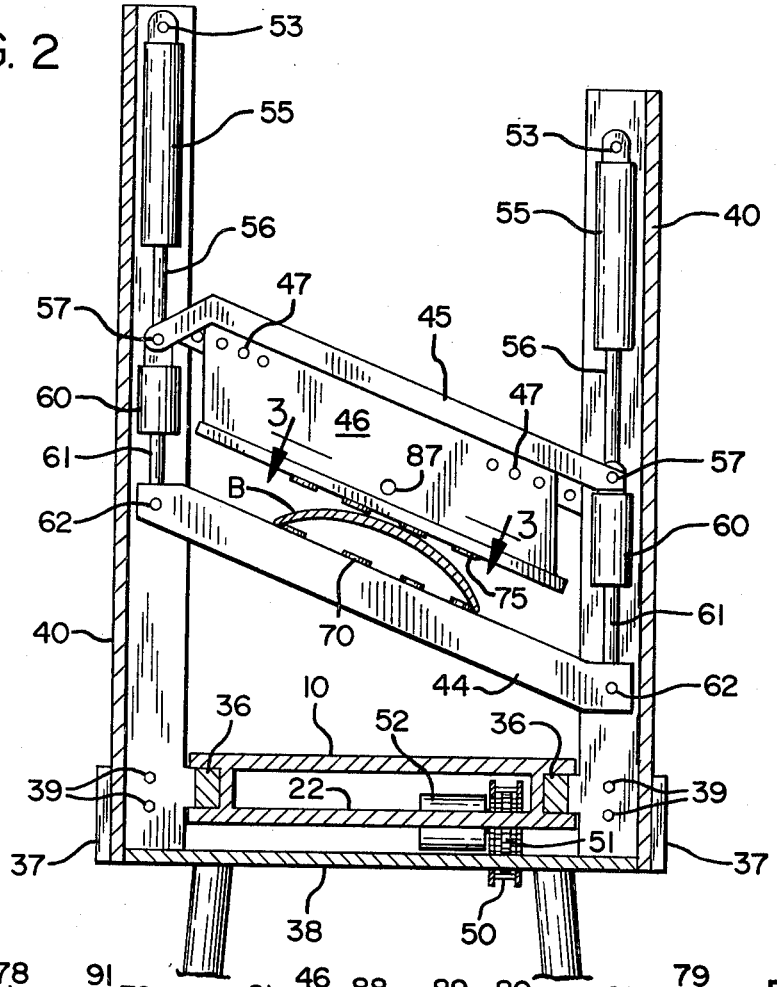
FIG. 2 is a sectional view on the line 2—2 in FIG. 1.
Figure 3:
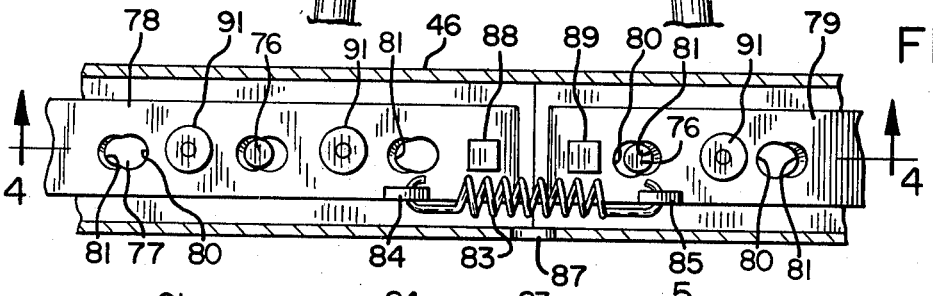
FIG. 3 is a view on the line 3—3 in FIG. 2.

The head frame 41 as thus described is shifted along the table by an endless chain 50 on a pair of sprocket wheels 51 at opposite ends of the table. As seen in FIG. 2 the upper reach of chain 50 slides on plate 22 under the table and the lower reach of the chain is connected to cross bar 38. One of the sprocket wheels 41 is driven by a slow speed hydraulic motor 52 under the control of valve handle 54 in FIG. 1. This is a three position valve having an off position and two on positions for opposite directions of rotation.

The entire beam assembly 44, 45 in FIG. 2 is suspended by a pair of cylinders 55 on pins 53 in the channel legs 40, said cylinders having piston rods 56 connected to pins 57 in the opposite ends of presser foot beam 45. Anvil beam 44 is supported by a pair of cylinders 60 on the pins 57 and having piston rods 61 connected to pins 62 in the opposite ends of anvil beam 44.

Cylinders 55 are double acting cylinders controlled so that they may act in unison to raise or lower the beam assembly 44, 45 without changing its inclination, or may act individually or in opposite directions to twist the blade B when required. Thus, each valve handle 65 controls a three position valve for admitting hydraulic fluid to one end or the other of its cylinder 55, and having a third position to close the ports at both ends of the cylinder to hydraulically lock the piston in the cylinder. Valve handles 66 control float valves for the cylinders 55, to open the ports at both ends of each cylinder and allow the beams 44, 45 to be supported and positioned by the propeller blade when desired.

Anvil cylinders 60 are also double acting cylinders controlled by three position valve handles 67 which have one position to admit fluid pressure to the lower ends of the cylinders to clamp anvil beam 44 to the propeller blade, one position to hydraulically lock the clamp and one position to admit fluid pressure to the upper ends of the cylinders to open the clamp quickly.

Figure 6:
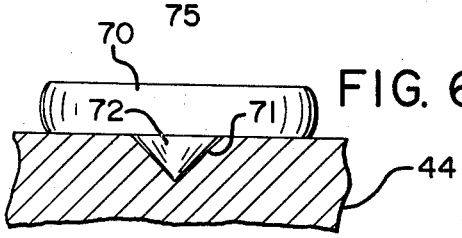
FIG. 6 is a fragmentary sectional view through the anvil beam in FIGS. 1 and 2 showing the placement of a block thereon.

As shown in FIG. 6 the anvil beam 44 is adapted to position one or more blade engaging blocks 70 on its upper surface. For this purpose the beam is provided with a series of concial depressions 71 in its upper surface to receive mating conical protuberances 72 on the undersides of blocks 70.

Figure 4:
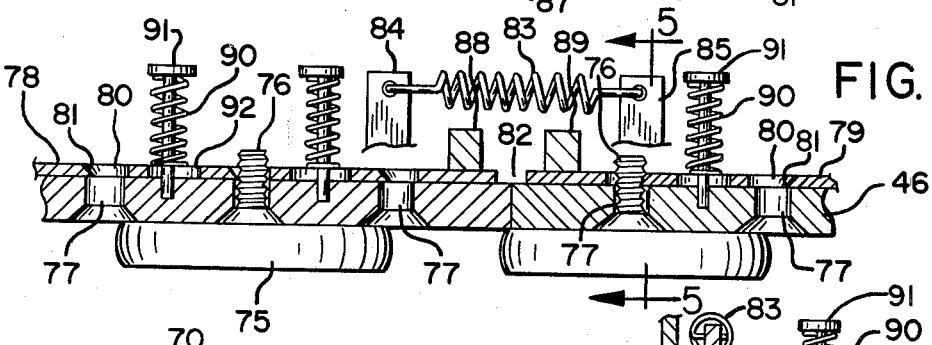
FIG. 4 is a view on the line 4—4 in FIG. 3.
Figure 5:
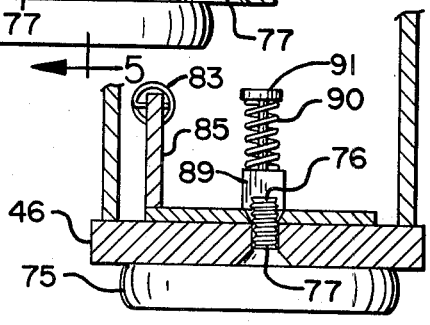
FIG. 5 is a view on the line 5—5 in FIG. 4.

In a similar manner presser foot beam shoe 46 is adapted to mount one or more blade engaging blocks 75 on its under surface as shown in FIGS. 4 and 5. Each block 75 has a threaded stud 76 which is insertable in a smooth unthreaded hole 77 in the under surface of shoe 46. Studs 76 are retained in the holes 77 by a pair of sliding plates 78 and 79 having holes 80 which register with the holes 77. Holes 80 are slightly larger than studs 76 and one side of each hole 80 has a beveled lip or partial thread 81 to engage in the groove of the thread on stud 76.

Slide plate 78 and 79 are pulled together with their ends abuting each other at 82 by a spring 83. One end of spring 83 is connected to an ear 84 on slide plate 78 and the opposite end of the spring is connected to an ear 85 on slide plate 79. When it is desired to insert a stud 76 into one of the holes 77 a screwdriver is inserted in hole 87 in FIG. 2 and manipulated to pry slide plate tab 88 to the left if a block 75 is to be inserted in the left end of shoe 46 or the screwdriver is manipulated to pry tab 89 to the right if a block 75 is to be inserted in the right end of shoe 46. Such screwdriver manipulation moves the involved slide plate to bring holes 80 into approximate register with the holes 77 in the shoe allowing the stud 76 to be thrust upward through the holes. Upon removable of the screwdriver, spring 83 engages beveled or threaded edge 81 of a hole 80 with the thread on stud 76 to retain the block 75.

Insertion of stud 76 as just described is facilitated by springs 90 on pins 91 in the shoe 46. These springs allow the slide plates 78 and 79 to yield in an upward direction and admit the stud 76 into holes 80 if the latter are not moved into accurate register with holes 77 by the screwdriver manipulation. Slots 92 in slide plates 78 and 79 allow the sliding movements just described. Blocks 75 are removed by the same screwdriver manipulation causing beveled edges 81 of the holes 80 to release the studs 76 allowing them to drop out of holes 77.

To repair a damaged propeller it is placed on the bolt 11 and nut 12 is screwed hand tight. Valve lever 30 is moved to extend piston rod 27 and move wedge 25 in FIG. 7 which clamps the propeller hub very tightly down on table 10. Then, with anvil beam 44 lowered to go under a blade of the propeller and shoe 46 raised to a position to go over the blade, valve lever 54 is manipulated to drive chain 50 and shift head frame 41 into the desired position along the length of the propeller blade to be repaired. Blocks 70 and 75 are positioned to remove dents or perform other functions and cylinders 60 are actuated by valve handles 67 to squeeze the blade between anvil 44 and shoe 46 as necessary.

Cylinders 55 are individually controlled by valve levers 65 to bend the blade up or down or hold one edge in position while the other edge is lifted or dropped to adjust the pitch of a blade. When one blade has then been thus repaired the anvil 44 is loosened by valve levers 67 and head frame 41 is moved away to the left in FIG. 1 by valve lever 54. Wedge 25 is retracted by valve lever 30 to remove the force acting on nut 12 so that the propeller may be turned on bolt 11 to rotate another blade into position to be received between anvil beam 44 and shoe 46. Then the process of clamping the propeller against rotation and operating on the second blade is repeated as described for the first blade.

The hydraulic circuits for operating the hydraulic mechanisms in the manner described are conventional and the illustration of such details is not deemed necessary to an understanding of the invention.

By removing pins 39 in FIGS. 1 and 2 the head frame 41 may be reversed to service a propeller of opposite rotation. Thus the legs 40 and cylinders 55 may avoid excessive length to reverse the inclination of clamping beams 44 and 45.

As shown in FIGS. 1 and 7 a suitable spacer such as washer 95 may be necessary to elevate the propeller so that anvil beam 44 will pass under the blade to be repaired.

In the modification in FIG. 9 a single cylinder 100 takes the place of the two cylinders 60 in FIG. 2 to pull anvil 44 up against the presser foot shoe 46. Cylinder 100 is pivotly mounted at 101 in the center of presser foot beam 45. A cable 102 is trained over a pulley 103 on piston rod 104. The lower ends of the cable are trained around pulleys 105 in the ends of show 46 and connected at 106 to the ends of anvil beam 44.

Cylinder 100 is also a double acting cylinder to clamp, hold and release rapidly. There being only one cylinder 100 only one valve control lever 67 is required in FIG. 1, this being a three position four-way valve as described above. In all other respects the modification in FIG. 9 is the same as the machine in FIG. 1 so further illustration of the modification is deemed unnecessary.

What is claimed is:

1. A propeller reconditioner comprising means to hold the propeller in a fixed position, an anvil beam extending transversely of one blade of the propeller and arranged to engage one side of said blade, a presser foot beam approximately parallel with said anvil beam and having a shoe arranged to engage the opposite side of said blade, means operable on said beams to clamp said blade between the beams, means operable on said beams to tilt said beams relative to the axis of the propeller, and means to shift said beams in a radial direction along said blade toward and away from said axis of the propeller.

2. A propeller reconditioner as defined in claim 1, said clamping and tilting means being operable on the ends of said beams.

3. A propeller reconditioner as defined in claim 2, said clamping and tilting means comprising hydraulic cylinders and pistons.

4. A propeller reconditioner as defined in claim 3, said axis of the propeller and the axis of said cylinders being vertical.

5. A propeller reconditioner as defined in claim 4, said propeller being supported on a table, and said cylinders being mounted in an inverted U-shaped head frame on said table.

6. A propeller reconditioner as defined in claim 5, said head frame being movable on said table toward and away from said axis of the propeller by an hydraulic motor.

7. A propeller reconditioner as defined in claim 6 including tracks on opposite sides of said table, said head frame being movable as a carriage on said tracks, and said head frame being reversible on said tracks to accommodate propellers of either left or right hand rotation.

8. A propeller reconditioner as defined in claim 6 including an endless chain on sprocket wheels on said table driven by said motor, said head frame being connected to said chain.

9. A propeller reconditioner as defined in claim 5, said head frame having a pair of vertical channel shaped legs on opposite sides of said table, said tilting cylinders being supported at their upper ends in said channels and having piston rods in their lower ends connected with the ends of said presser foot beam, and said clamping cylinders being supported at their upper ends from said ends of said presser foot beam and having piston rods in their lower ends connected with the ends of said anvil beam.

10. A propeller reconditioner as defined in claim 5, said cylinders comprising said tilting means being mounted in the vertical legs of said head frame, said clamping means comprising a cylinder mounted on the center of said presser foot beam and a cable connected at its ends to the ends of said anvil beam and engaged intermediate its ends by a piston rod in said last cylinder.

11. A propeller reconditioner as defined in claim 1, the propeller blade confronting surface of said anvil beam containing a series of depressions therein, and a blade engaging block having a protuberance on its back side to fit in saiddepressions and position the block on a selected one of said depressions.

12. A propeller reconditioner as defined in claim 1 including a propeller blade engaging block for said presser foot beam shoe, and means for detachably mounting said block in selected positions along said shoe.

13. A propeller reconditioner as defined in claim 12, said last means comprising a stem on said block, a series of openings in said shoe to receive said stem, and means for locking said stem in any one of said openings.

14. A propeller reconditioner as defined in claim 13, said last means comprising a circumferential groove in said stem, a slide plate on said shoe behind said openings, said slide plate having openings in register with said shoe openings to receive said stem, and a spring acting on said slide plate to shift said slide plate openings out of register with said shoe openings and cause an edge of a slide plate opening to engage said groove in said stem.

15. A propeller reconditioner as defined in claim 1, said means to hold the propeller in a fixed position comprising a hub support member engagable with one end of the propeller hub, a bolt extending loosely through said support member and arranged to extend through the propeller shaft opening in said hub, a nut on the outer end of said bolt to engage the opposite end of said hub, a nut on the inner end of said bolt behind said support member, means to prevent rotation of said inner end nut while permitting limited axial movement thereof, a block in the nature of a washer on said bolt between said inner end nut and said support member, a wedge between said nut and said block, and means for tightening and loosening said wedges 16. A propeller reconditioner as defined in claim 15 including an hydraulic cylinder for tightening and loosening said wedge.

17. A propeller reconditioner as defined in claim 15 including a compression coil spring at said inner end of said bolt pressing said bolt in an outward direction.

18. Means to hold a propeller in a fixed position comprising a hub support member engagable with one end of the propeller hub, a bolt extending loosely through said support member and arranged to extend through the propeller shaft opening in said hub, a nut on the outer end of said bolt to engage the opposite end of said hub, a nut on the inner end of said bolt behind said support member, means to prevent rotation of said inner end nut while permitting limited axial movement thereof, a block in the nature of a washer on said bolt between said inner end nut and said support member, a wedge between said nut and said block, and means for tightening and loosening said wedge.

19. A mechanism as defined in claim 18 including an hydraulic cylinder for tightening and loosening said wedge.

20. A mechanism as defined in claim 18 including a compression coil spring at said inner end of said bolt pressing said bolt in an outward direction.

* * * * *